US007967552B2

(12) United States Patent
Brett et al.

(10) Patent No.: US 7,967,552 B2
(45) Date of Patent: Jun. 28, 2011

(54) DRIVE SPINDLES

(76) Inventors: Neil Edward Brett, Dorset (GB); Graham Cox, Lincoln (GB); Chris Robinson, Lincoln (GB)

( * ) Notice: Subject to any disclaimer, the term of this patent is extended or adjusted under 35 U.S.C. 154(b) by 989 days.

(21) Appl. No.: 11/574,626

(22) PCT Filed: Sep. 2, 2005

(86) PCT No.: PCT/GB2005/003386

§ 371 (c)(1),
(2), (4) Date: Mar. 2, 2007

(87) PCT Pub. No.: WO2006/024861

PCT Pub. Date: Mar. 9, 2006

(65) Prior Publication Data

US 2007/0257131 A1 Nov. 8, 2007

(30) Foreign Application Priority Data

Sep. 3, 2004 (GB) ..... 0419616.8
Jan. 28, 2005 (GB) ..... 0501806.4

(51) Int. Cl.
*F03B 1/00* (2006.01)

(52) U.S. Cl. ..... 415/80; 415/904

(58) Field of Classification Search ..... 415/80, 415/81, 904, 903, 92
See application file for complete search history.

(56) References Cited

U.S. PATENT DOCUMENTS 3,057,558 A * 10/1962 Verba et al. ..... 239/700
3,120,346 A * 2/1964 Willhoite ..... 239/214.13
4,275,838 A * 6/1981 Fangmeyer ..... 239/223
4,384,682 A * 5/1983 Sugiyama et al. ..... 239/703
4,555,058 A * 11/1985 Weinstein et al. ..... 239/223
4,589,597 A * 5/1986 Robisch et al. ..... 239/703
4,718,920 A * 1/1988 Kinsey et al. ..... 95/71
4,919,333 A * 4/1990 Weinstein ..... 239/223
5,037,029 A * 8/1991 Garet et al. ..... 239/77

(Continued)

FOREIGN PATENT DOCUMENTS

EP 1 384 516 1/2004

(Continued)

OTHER PUBLICATIONS

Search Report and Written Opinion dated Nov. 23, 2005 for PCT/GB2005/003386.

*Primary Examiner* — Edward Look
*Assistant Examiner* — Aaron R Eastman
(74) *Attorney, Agent, or Firm* — Alston & Bird LLP

(57) ABSTRACT

A rotary atomiser drive spindle for use as part of a rotary atomiser, the drive spindle comprising a shaft which carries a turbine and a body which comprises at least one supply channel for supplying gas to the turbine for rotatingly driving the shaft relative to the body. The turbine comprises a rotor body portion, which is ring shaped, and a plurality of blades projecting from one of the generally flat surfaces of the rotor body portion. Generally radial gas paths through the turbine are defined by adjacent pairs of blades. The at least one supply channel comprises a nozzle portion from which, in use, gas leaves the body of the spindle towards the turbine. Each nozzle comprises an outlet and the cross sectional area of the gas passage through the nozzle portion decreases monotonically from the inlet of the nozzle to the outlet. Two turbines may be provided and exhaust air may be used for cooling.

40 Claims, 12 Drawing Sheets

U.S. PATENT DOCUMENTS

| | | | | |
|---|---|---|---|---|
| 5,073,433 | A * | 12/1991 | Taylor | 428/134 |
| 5,697,559 | A * | 12/1997 | Davis et al. | 239/703 |
| 5,704,977 | A * | 1/1998 | Baumann et al. | 118/323 |
| 5,707,009 | A * | 1/1998 | Schneider | 239/112 |
| 6,105,886 | A * | 8/2000 | Hollstein et al. | 239/700 |
| 7,080,794 | B2 * | 7/2006 | Baumann et al. | 239/223 |
| 2002/0043576 | A1 * | 4/2002 | Dion | 239/703 |
| 2004/0000604 | A1 * | 1/2004 | Vetter et al. | 239/700 |
| 2004/0081769 | A1 * | 4/2004 | Krumma et al. | 427/421 |
| 2004/0195406 | A1 * | 10/2004 | Murai et al. | 239/700 |
| 2005/0001057 | A1 * | 1/2005 | Baumann et al. | 239/225.1 |
| 2006/0208102 | A1 * | 9/2006 | Nolte et al. | 239/224 |

FOREIGN PATENT DOCUMENTS

| | | | |
|---|---|---|---|
| EP | 1 388 372 | | 2/2004 |
| EP | 1388372 | A1 * | 2/2004 |
| GB | 2 097 291 | | 11/1982 |

* cited by examiner

DRIVE SPINDLES

BACKGROUND OF THE INVENTION

1. Field of the Invention

This application relates to drive spindles, in particular rotary atomiser drive spindles as well as rotary atomisers including such drive spindles. This application further relates to turbine rotors for use in such drive spindles.

2. Description of Related Art

Rotary atomisers are used for spraying material in particulate form onto a target. One of the common uses for rotary atomisers is that of paint spraying.

A rotary atomiser generally includes a supply arrangement for supplying material from a supply source to an atomising bell which serves to break up, or atomise, the material and project this towards the target. The atomising bell is rotatingly driven and therefore drive must be provided for the bell. Recently there has been increased demand for higher performing rotary atomisers. In particular there has been demand for rotary atomisers for use in the paint spraying industry which are able to spray paint more quickly, i.e. sprayers that provide a greater throughput of material so that more liters of paint per minute may be sprayed. Most of these rotary atomisers or paint sprayers are electrostatic devices where a high voltage is applied between the device and the target to draw the atomised material, eg paint, to the target.

BRIEF SUMMARY OF THE INVENTION

It is an object of the present invention to provide rotary atomiser drive spindles as well as rotary atomisers and components therefor which provide good performance.

According to one aspect of the present invention there is provided a rotary atomiser drive spindle for use as part of a rotary atomiser, the drive spindle comprising a shaft which carries a turbine and a body which comprises at least one supply channel for supplying gas to the turbine for rotatingly driving the shaft relative to the body.

In one set of embodiments the turbine comprises a rotor body portion, which is one of disc shaped and ring shaped, and a plurality of blades projecting from one of the generally flat surfaces of the rotor body portion with generally radial gas paths through the turbine being defined by adjacent pairs of blades and the at least one supply channel comprises a nozzle portion from which, in use, gas leaves the body of the spindle towards the turbine, the nozzle comprising an outlet and the cross sectional area of the gas passage through the nozzle portion decreasing monotonically from the inlet of the nozzle to the outlet.

The turbine may be a reaction turbine. In this specification the expression reaction turbine is used to refer to a turbine in which at least some torque, ie drive, is developed from a gradual decrease in gas pressure from the inlet to the outlet of the turbine. The use of a reaction turbine generally can improve efficiency of a rotary atomiser in terms of throughput of material through the atomiser compared to use of an impulse turbine in which drive is developed by virtue of the direct impact of jets of gas onto blades of the turbine.

The turbine may comprise a plurality of blades with gas paths through the turbine being defined by adjacent pairs of the blades. The turbine may be arranged so that at least one gas path has a first portion which decreases in cross sectional area from a first end to a second end, the first end being nearer to the inlet of the turbine than the second end.

A reduction in cross sectional area of gas path through part of the turbine can lead to the turbine acting as a reaction turbine.

The turbine may be arranged so that said at least one gas path has a second portion which second portion increases in cross sectional area from a first end to a second end, the first end being nearer to the inlet of the turbine than the second end. The second portion may be further from the inlet to the turbine than is the first portion.

The turbine may comprise a rotor body portion and a plurality of blades provided on the rotor body portion. The rotor body portion may be generally disc or ring shaped.

Preferably the blades have the same shape and dimensions as one another. Preferably the gas paths have the same shape and dimensions as one another.

Preferably surfaces of the blades which face respective adjacent blades are curved in one direction but substantially flat in the other direction. The curvature allows desired blade shapes and gas path cross sections to be achieved and limiting curvature to one direction eases machining.

In some embodiments the blades may project from one of the generally flat surfaces of a generally disc or ring shaped rotor body portion. In such a case the facing surfaces of the blades may be curved in a generally radial direction and substantially flat in a generally axial direction.

The turbine blades may have an aerofoil shape. Drive may be developed due to aerofoil effects, ie "lift", as the gas flows around and between the blades.

The turbine blades may be dimensioned and arranged to maintain laminar flow under a wide range of differing operating conditions.

The turbine may comprise at least one surface feature to help reduce losses. The surface feature may comprise any one of or any combination of a recess, an aperture and a groove to help reduce losses. Typically the surface features are provided on non-working surfaces of the turbine. The expression non-working surface is used to refer to a surface past which gas need not or should not flow in generating drive. In one example each blade may be provided with a generally axial aperture or a blind recess which extends generally axially. In another example a circumferential groove may be provided in the outer curved surface of the turbine. Where the surface features result from removal of material of the turbine there can be a further advantage of reduced weight and/or moment of polar inertia.

The turbine may be a radial feed turbine.

The at least one supply channel may comprise a nozzle portion from which, in use, gas leaves the body of the spindle towards the turbine. The nozzle portion may comprise a throat. In this specification the expression throat is used to refer to a relatively narrow part of the nozzle passage between broader inlet and outlet ends of the nozzle.

The cross sectional area of gas passage through the nozzle portion may decrease monotonically towards the throat. Preferably the cross sectional area of the gas passage through the nozzle portion decreases monotonically from the inlet of the nozzle to the throat. The width of the nozzle may decrease monotonically to give the desired reduction in cross-sectional area.

The passage through the nozzle may be partially defined by a suction surface and partially defined by a pressure surface. The suction surface is that surface at which pressure in gas flowing through the nozzle will be lowest and the pressure surface is that surface at which pressure in gas flowing through the nozzle will be highest. The suction surface may have continuous curvature.

Preferably the reduction in nozzle cross section is achieved by a reduction in one dimension of the nozzle passage with the other dimension of the passage remaining substantially constant. This eases the machining process.

The nozzle may follow an arcuate path in a plane which is perpendicular to a principle axis of the spindle.

Preferably the outlet of the nozzle is arranged to feed gas to a plurality of gas paths through the turbine simultaneously.

Preferably there are a plurality of nozzles for supplying gas to the turbine to drive the turbine.

The spindle body may comprise a gas supply chamber which is arranged to feed gas to the or each nozzle.

The volume of the gas supply chamber may be chosen to ensure a sufficient supply of gas is provided to the nozzles. The intended operating temperature of the device is one factor that can influence the choice of the size of the gas supply chamber.

The depth of gas supply chamber in the axial direction of the spindle may differ to the depth, in the axial direction, of the or each nozzle.

The cross sectional area of the nozzle may be chosen to regulate input power. The width and depth may be selected independently.

The number of nozzles and blades may be chosen to give desired power and other characteristics. Where there is more than one nozzle the angular separation of these may be chosen to suit practical issues.

The rear of the turbine may be used for carrying an indicator used in a speed pick up system. The speed pick up system might for example be optical or magnetic.

The turbine may be arranged with either orientation relative to the spindle body; the blades may face towards or away from the bearing.

The spindle body may comprise an exhaust system including at least one exhaust passage for carrying gas away from the outlet of the turbine. The exhaust system may comprise an exhaust collection chamber part way between the outlet of the turbine and an outlet of the exhaust system. The exhaust collection chamber can help to slow the exhaust gas and ease its path from the spindle. Preferably the exhaust system comprises at least one exhaust gathering passage for supplying exhaust from the outlet of the turbine to the exhaust collection chamber and a plurality of exhaust outlet passages for allowing exhaust gas to escape from the collection chamber to the exterior.

The exhaust collection chamber may be provided at a location where the exhaust gas must change direction to escape. For example, the collection chamber may be arranged to receive exhaust gas flowing generally axially in one direction and to output exhaust gas flowing generally axially in the opposite direction. The exhaust collection chamber may be provided by machining out material of the spindle body.

The exhaust system may be designed to inhibit or prevent turbulent flow and/or back pressure to maximise pressure drop across the turbine.

At least one exhaust passage may pass through the body of the spindle adjacent to but radially displaced from the gas supply chamber. Said at least one exhaust passage may pass the gas supply chamber radially inwards of the gas supply chamber. This can help lead to a compact design. Altering the axial depth of the gas supply chamber as mentioned above so that this is greater than the axial depth of the nozzle can help to ensure that the gas supply chamber has adequate volume.

The drive spindle may be an air bearing spindle. The body may comprise an air bearing in which the shaft is journalled for rotation.

The shape of the or each nozzle may be that substantially defined by the co-ordinates given in table 1.

The shape of the or each nozzle may be that defined by the co-ordinates given in table 1 to within 0.01 of each co-ordinate value.

The shape of the or each blade may be substantially that defined by the co-ordinates given in table 2.

The shape of the or each blade may be that defined by the co-ordinates given in table 2 to within 0.01 of each co-ordinate value.

The spindle body may comprise a main body portion, a spacer ring, a turbine feed ring and a rear cover. The nozzles may be partly defined by the turbine feed ring. The gas supply chamber may be partly defined by the turbine feed ring. The spacer ring may serve to complete the boundaries of the nozzles and/or the gas supply chamber. The exhaust collection chamber may be provided by a recess provided in the main body portion. Another surface of the exhaust collection chamber may be provided by the spacer ring. The exhaust passages and air supply passages may be provided by appropriate apertures provided in one or more of the main body portion, the spacer ring, the turbine feed ring and the rear cover.

A tip clearance may be defined between the turbine blades and the spacer ring. This tip clearance may be minimised to reduce leakage and hence losses.

In some embodiments a plurality of turbines may be provided. These may be provided back to back or back to front.

Preferably the rotary atomiser is suitable for use as a paint sprayer.

According to another aspect of the present invention there is provided a rotary atomiser which comprises a drive spindle as defined above, a bell-shaped member which is rotatable about a principle axis and is arranged to project a conical curtain of small particles flowing generally towards a target and a supply arrangement for supplying material, from which the small particles can be generated, from a reservoir source to the bell-shaped member.

According to yet another aspect of the present invention there is provided a rotary paint sprayer drive spindle comprising a shaft which carries a turbine and a body which comprises at least one supply channel for supplying gas to the turbine for rotatingly driving the shaft relative to the body.

According to a further aspect of the present invention there is provided a rotary paint sprayer air bearing drive spindle comprising a shaft which carries a turbine and a body which comprises at least one supply channel for supplying gas to the turbine for rotatingly driving the shaft relative to the body.

According to a further aspect of the present invention there is provided a turbine rotor for a rotary atomiser drive spindle, the turbine rotor comprising a plurality of blades with gas paths through the turbine being defined by adjacent pairs of the blades and being arranged so that at least one gas path has a first portion which decreases in cross sectional area from a first end to a second end, the first end being nearer to the inlet of the turbine than the second end.

According to another aspect of the present invention there is provided a turbine rotor for a rotary atomiser drive spindle, the turbine rotor being arranged to act as a reaction turbine.

Rotary atomiser (eg paint spraying) drive spindles are sometimes mounted on robotic arms. If the orientation of the drive spindle is changed whilst the shaft is running at high speed then the shaft is subject to gyroscopic forces. These forces can be quite high relative to the stiffness of the shaft's mounting in the body of the spindle. Especially where air bearings are used, the couple (turning moment) exerted on the shaft due to gyroscopic effects can exceed the couple which the bearings can withstand. This can cause failure of the spindle as the shaft tilts within the bearings to an extent where the shaft contacts the material of the bearing and/or another part of the body of the spindle. This factor can actually become the limiting factor on how fast the orientation of a spray head (including such a drive spindle) can be changed to perform a desired spraying operation. By the same token it can limit the speed at which the shaft may be allowed to rotate if a given rate of reorientation of the spray head is required.

In developments of the invention the structure of the spindle is arranged to alleviate this problem.

In at least some cases these structures can lead to a spindle with improved dynamics allowing the shaft to be driven at higher speed. This can lead to further problems due to increased heating in the spindle. In other developments of the invention the structure of the spindle is arranged to alleviate this problem.

The body of the spindle may comprise two radial bearings which are spaced from one another. Each radial bearing may comprise an air bearing.

The turbine may be disposed between the spaced radial bearings. The shaft may carry two turbines which are disposed between the spaced radial bearings. The turbines may be arranged in a back to back configuration so that the blades on one bearing face away from the blades on the other bearing.

Each turbine may be fed with drive gas by two nozzles. There may be four nozzles, two for supplying gas to a first of the turbines and two for supplying gas to the second of the turbines. The body of the spindle may comprise a first gas supply channel for feeding drive gas to a first nozzle arranged to supply gas to the first turbine and a first nozzle arranged to supply gas to the second turbine. The body of the spindle may comprise a second gas supply channel for feeding drive gas to a second nozzle arranged to supply gas to the first turbine and a second nozzle arranged to supply gas to the second turbine. The first and/or second gas supply channels may lead continuously from the exterior of the spindle to the respective nozzles. The arrangement may be such that there is no gas supply chamber arranged to feed gas to the nozzles, instead the nozzles may be fed directly from the gas supply channel.

The exhaust system may be arranged so that escaping exhaust gas cools the spindle. Where there are two, spaced, radial bearings, the exhaust system may be arranged so that escaping exhaust gas cools both of the radial bearings.

At least one respective part of at least one exhaust passage may pass close to each radial bearing.

The exhaust system may comprise two exhaust collection chambers. A first of the collection chambers may be provided in the region of a first of the radial bearings. A second of the collection chambers may be provided in the region of a second of the radial bearings. Each collection chamber may be provided in a region towards the end of one of a respective one of the bearings.

The exhaust system may comprise a first exhaust gathering passage for supplying exhaust from the outlet of a first of the turbines to a first of the collection chambers.

The exhaust system may comprise a second exhaust gathering passage for supplying exhaust from the outlet of a second of the turbines to a second of the collection chambers.

There may be a plurality of common exhaust outlet passages that are arranged to allow exhaust to escape from both of the collection chambers.

The turbines may be arranged so that exhaust leaving one of the turbines travels in a direction generally opposite to exhaust leaving the other of the turbines.

The bearings may be rigidly mounted in the remainder of the body of the spindle. This is in distinction to a set up where the bearings are mounted on say soft o-rings in the body of the spindle to provide an elastic mounting.

The spindle body may comprise all of or a sub-combination of: a first main body portion, a first spacer ring, at least one turbine feed ring, a second spacer ring, a second main body portion and a cover portion.

The turbine feed ring may at least partly define the nozzles arranged to feed gas to the first turbine and the second turbine. The respective spacer rings may serve to complete the boundaries of the nozzles. The first exhaust collection chamber may be provided by a recess provided in the first main body portion. The second exhaust collection chamber may be provided by a recess provided in the second main body portion. Another surface of the collection chambers may be provided by the respective spacer ring. The exhaust passages and air supply passages may be provided by appropriate apertures provided in one or more of the first main body portion, the second main body portion, the first spacer ring, the second spacer ring, the turbine feed ring and the cover portion.

The spindle may be at least partly of aluminium and leaded gunmetal. This can help ensure good thermal conduction from the bearing surfaces to the boundary of the collection chambers.

According to another aspect of the present invention there is provided a rotary atomiser drive spindle comprising a shaft which carries a turbine and a body which comprises at least one supply channel for supplying gas to the turbine for rotatingly driving the shaft relative to the body, wherein the body comprises two bearings in which the shaft is journalled and which are spaced from one another with the turbine disposed therebetween and further comprises an exhaust system comprising two exhaust collection chambers, a respective one of which is disposed in the region of each bearing.

BRIEF DESCRIPTION OF THE SEVERAL VIEWS OF THE DRAWINGS

Embodiments of the present invention will now be described by way of example only with reference to the accompanying drawings in which.

DETAILED DESCRIPTION OF THE INVENTION

Figure 1:
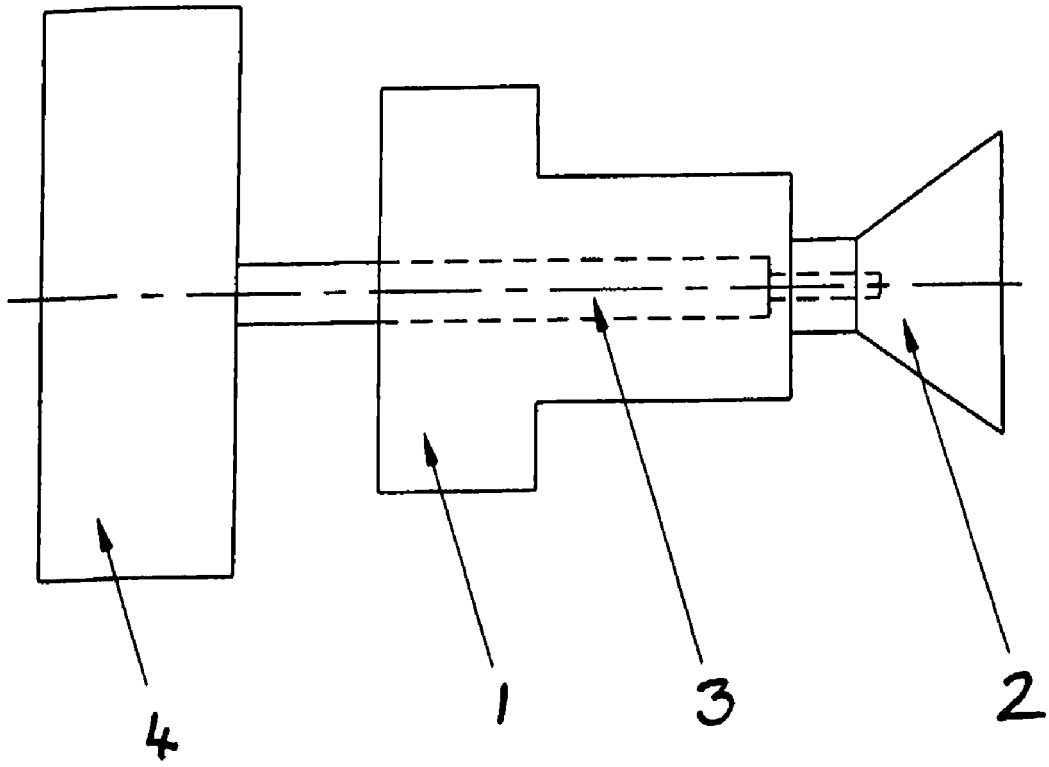
FIG. 1 schematically shows a rotary atomiser in the form of a paint spraying device.

FIG. 1 schematically shows a rotary atomiser in the form of a paint sprayer which comprises a drive spindle 1 for rotatingly driving a paint spraying bell 2. The paint sprayer shown in FIG. 1 also comprises a supply arrangement 3 for supplying material, i.e. paint, from a reservoir 4 to the bell 2 so that this paint may be atomised by the bell member and projected towards the surface which is to be coated with paint. As is typical with paint sprayers such as this, paint is projected towards the surface to be painted by electrostatic force created by a high voltage applied between the spindle 1 and the surface to be painted.

The structure and operation of the paint sprayer at this level is conventional and such paint sprayers are widely used in the art and well understood. Therefore, for the sake of brevity no further description will be given of the paint spraying bell and supply arrangement 3 as there are many forms in which these may be manifested, as will be well known to those skilled in the art, and it is features of the drive spindle 1 which are pertinent to the present invention.

The drive spindle 1 will be described in more detail with reference to FIGS. 2 to 10.

Figure 2:
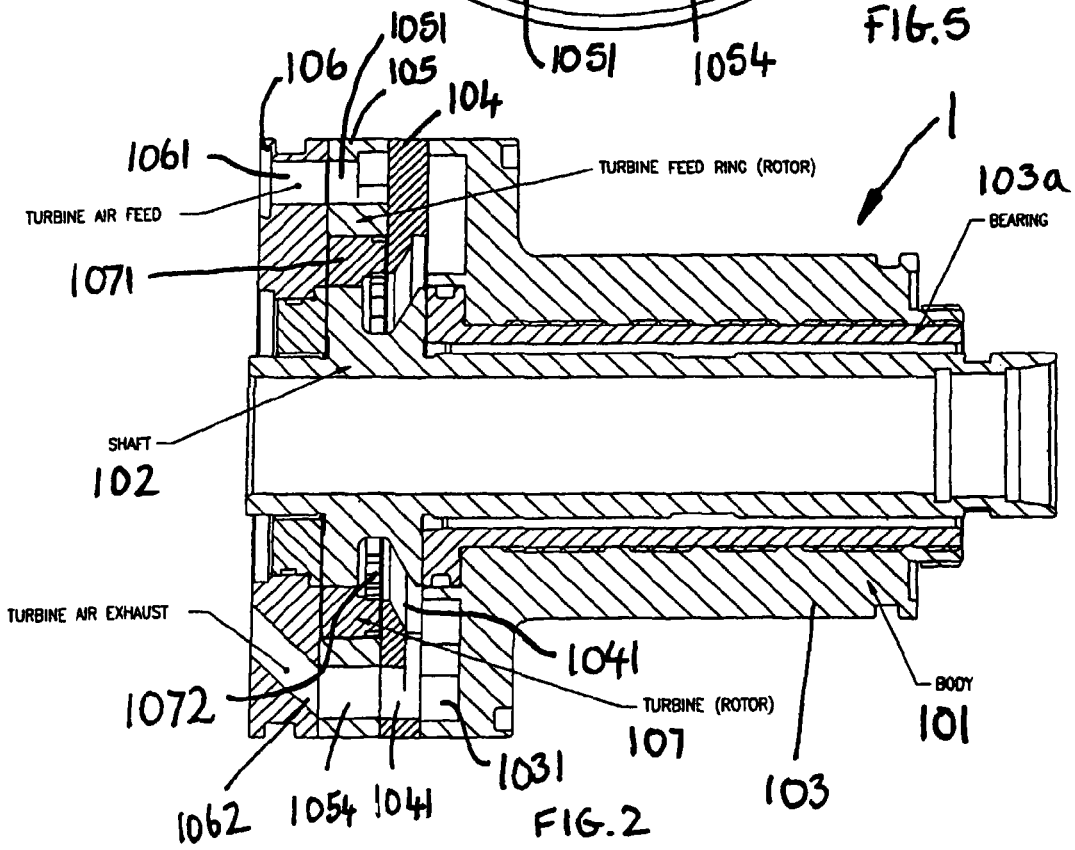
FIG. 2 shows a section through a drive spindle of the rotary atomiser shown in FIG. 1.

FIG. 2 is a section through the drive spindle 1 showing its main components. At the most general level the drive spindle 1 comprises a spindle body 101 which in normal use is static and a shaft 102 which is journalled for rotation within the spindle body 101.

The spindle body 101 itself comprises a number of components. First there is a main body portion 103 which houses an air bearing 103*a* in which the shaft 102 is journalled. Mounted to the main body portion 103 are a spacer ring 104, a turbine feed ring 105 and a rear cover 106.

Figure 5:
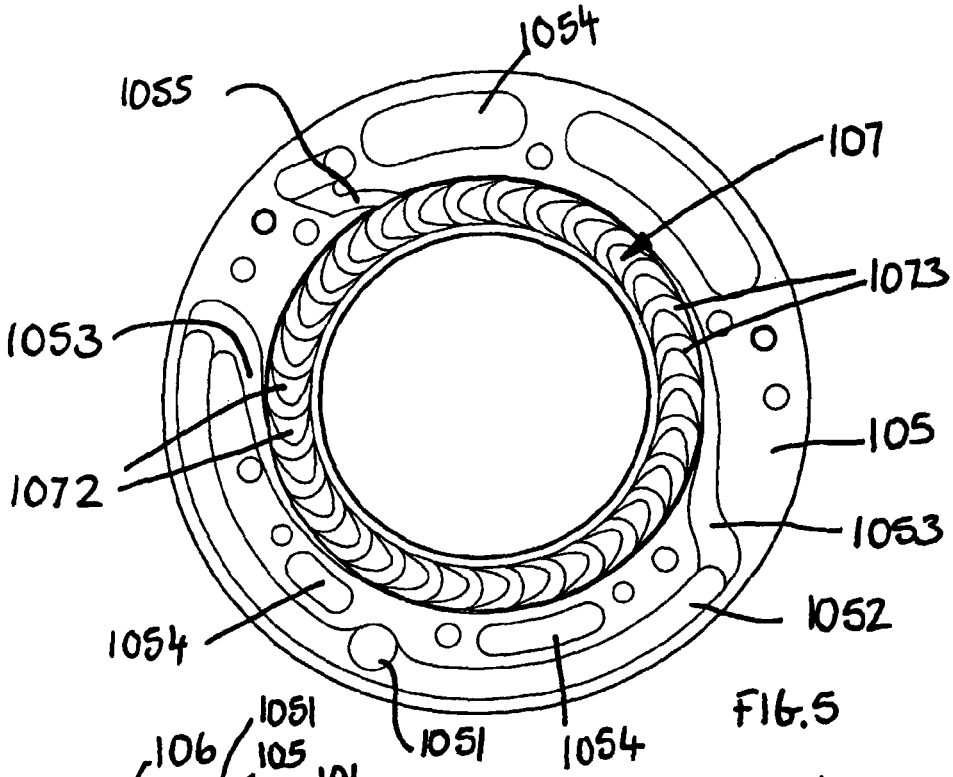
FIG. 5 is a plan view of a turbine feed ring and turbine of the drive spindle shown in FIG. 2.
Figure 3B:
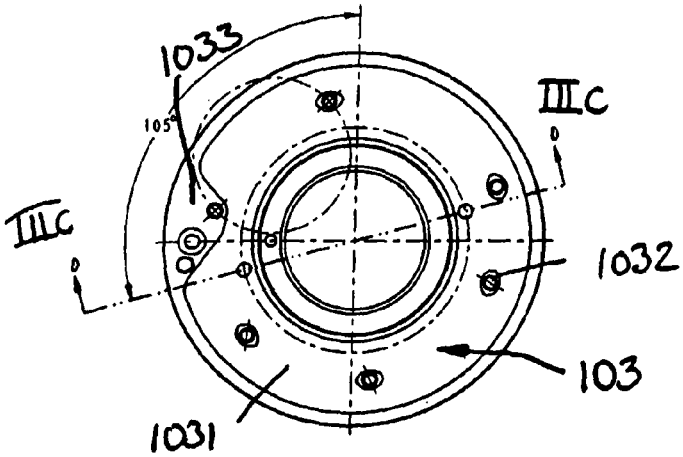
FIG. 3B is a plan view of the body portion shown in FIG. 3A.
Figure 3C:
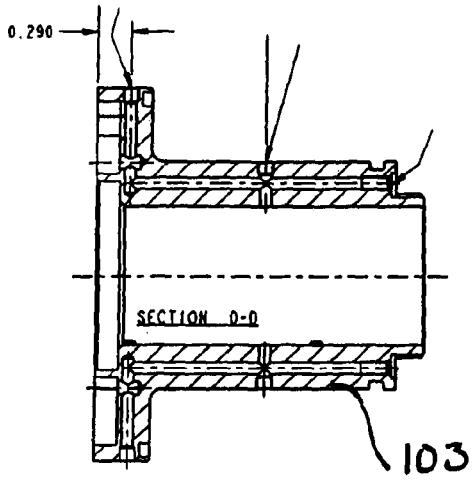
FIG. 3C is a section on line IIIC-IIIC of the body portion shown in FIG. 3B.
Figure 3A:
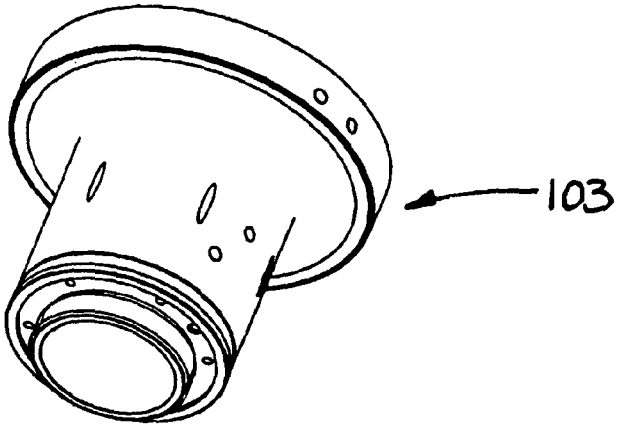
FIG. 3A is a perspective view of a main body portion of the drive spindle shown in FIG. 2.
Figure 6:
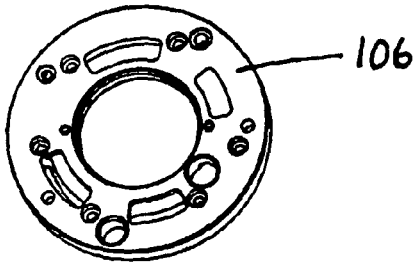
FIG. 6 is a perspective view of an end cover of the drive spindle shown in FIG. 2.
Figure 7:
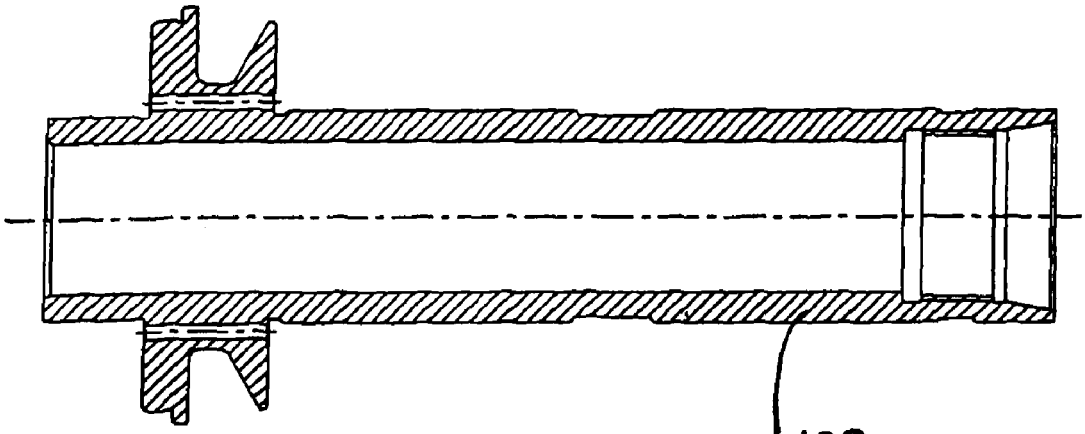
FIG. 7 is a sectional view of a shaft of the drive spindle shown in FIG. 2.
Figure 4:
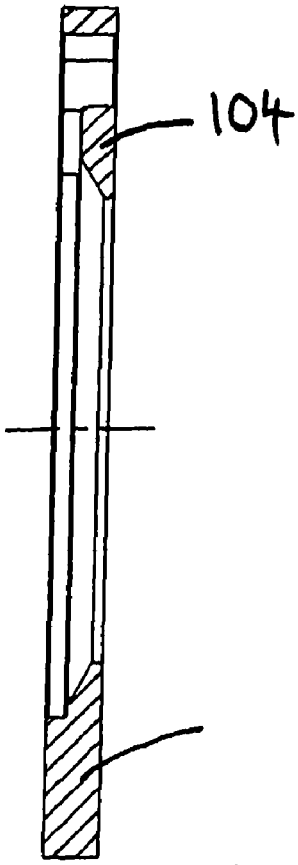
FIG. 4 is a sectional view of a spacer ring of the drive spindle shown in FIG. 2.

FIGS. 3A, 3B and 3C show the main body portion 103 in isolation and in more detail. FIG. 4 shows the spacer ring 104 in more detail, FIG. 5 shows the turbine feed ring 105 in more detail and FIG. 6 shows the rear cover 106 in more detail. The shaft 102 is shown in isolation in FIG. 7.

When assembled into the drive spindle as shown in FIG. 2, the shaft 102 carries a turbine 107. The turbine 107 is also shown in FIG. 5 in its assembled relationship with respect to the turbine feed ring 105.

In very general terms the drive spindle 1 operates by virtue of air being fed to the turbine 107 which serves to rotatingly drive the shaft 102 in order that the rotary atomiser and more particularly the paint spraying bell 2 may be driven. The use of turbines as a source of rotary drive is of course not new in itself but the drive spindle 1 of the present application includes various features which it is currently considered are new and which provide beneficial effects.

The turbine 107 is a radial flow turbine and comprises a generally ring shaped rotor body 1071 on which are provided a plurality of generally aerofoil like blades 1072. These blades 1072 project from one of the non-curved surfaces of the ring shaped rotor body 1071. Gas paths 1073 through the turbine 107 are defined by respective adjacent pairs of the blades. The turbine is arranged as a reaction turbine rather than an impulse turbine. That is to say at least some of the drive is achieved by a gradual extraction of energy out of the gas flowing through the gas paths 1073 rather than merely by the impact of a jet of air on the blade surfaces. In order to achieve this effect the blades are carefully shaped.

The drive spindle is arranged so that air is fed from the turbine feed ring 105 into the turbine 107 at its outer circumference and exits from the turbine 107 at the inner circumference of the ring like turbine. As can be seen in FIG. 5 the width of each of the gas paths 1073 is larger at the inlet side of the turbine (i.e. the outer circumference) than it is at the mid point of the gas path across the turbine. Furthermore, the width of the gas passage 1073 at the outlet side of the turbine is again greater than the width at the mid point of the gas passage 1073 although not as great as the width at the inlet of the gas passage 1073.

The walls of the blades 1072 in the direction out of the page as shown in FIG. 5 are substantially straight. That is to say the blades have uniform cross section in what is the axial direction of the drive spindle 1. This makes machining of the blades 1072 more straightforward and means that all variation in the cross sectional area of the gas flow paths 1073 through the turbine 107 is achieved by the shape of the blades in the plane generally perpendicular to the axis of the drive spindle 1. As mentioned above the blades 1072 each have an aerofoil type shape. It should also be noted that aerofoil shape is asymmetric. This helps in achieving the desired drive effects and the desired shape of gas passage 1073.

Air is supplied to the turbine 107 via a feed air passage created by respective apertures 1061 and 1051 in the rear cover 106 and turbine feed ring 105. This passage leads into a gas supply chamber 1052 which in turn is in fluid connection with two drive nozzles 1053. Each nozzle 1053 is arranged to follow a path in a plane that is generally perpendicular to the axis of the spindle. Each nozzle 1053 is transverse to the axis of the spindle. The path that the nozzles 1053 follow is arcuate. The nozzles 1053 can be considered to spiral in towards the axis of the spindle. Again the drive nozzles 1053 are carefully shaped and dimensioned to feed air to the turbine 107 in such a way as to give desired drive characteristics. In the present embodiment, again the shaping of the nozzles 1053 is in planes generally perpendicular to the axis of the drive spindle 1 with the side walls of the nozzles 1053 being generally straight in the direction parallel to the axis of the drive spindle 1. The cross sectional area of the nozzles 1053 in the axial direction is thus uniform. The nozzles 1053 have an inlet where they meet the gas supply chamber 1052 and an outlet where they meet an inner side wall of the turbine feed ring 105 and supply gas to the turbine 107. Between the inlet and outlet is a throat where the narrowest part of the nozzle 1053 is. This throat is located at one side of the outlet and beyond the throat one side wall of the nozzle 1053 stops and the nozzle 1053 merges into the space surrounding the turbine. Each of the nozzles 1053 is shaped so that there is a monotonic reduction in width (and therefore cross sectional area) of the nozzle 1053 between the inlet and the throat. Because of the merging of the nozzle 1053 into the space surrounding the turbine, the gas path through the nozzle 1053 in fact continues to decrease monotonically in cross-sectional area all of the way to the outlet. The outlet of each nozzle 1053 is arranged to supply gas to a plurality of blades 1072/gas passages 1073 simultaneously. In this case gas is supplied by each nozzle to a respective set of 4 or 5 blades at any one time with the most useful supply being to two of these blades 1072.

The nozzles can be considered to have a suction surface and a pressure surface. The suction surface is that surface at which gas in the nozzle during use will have the lowest pressure and the pressure surface is that surface within the nozzle at which gas will have the highest pressure. With the nozzle shapes illustrated in the present embodiment, the suction surface is the surface which is radially outermost of the nozzle 1053. Another feature of the present nozzle design is that this radially outer surface has continuous curvature rather than having any linear portions.

These features of monotonic reduction in width (cross sectional area) and continuous curvature are important in achieving the most efficient turbine operation.

From a consideration of FIG. 2 it can be seen that the ring like turbine 107 is disposed so as the blades 1072 face away from the rear cover 106. Portions of the blades 1072 can be seen in elevation in FIG. 2. Those portions which can be seen in elevation are those on the inner circumference of the ring shaped turbine rotor 107.

As mentioned above, in operation gas, ie typically air, passes through the turbine 107 in a generally radially inwards direction and thus the exhaust air must be exhausted away from this central region. Exhaust passages for this purpose are provided by respective exhaust apertures 1041, 1054 and 1062 in the spacer ring 104, the turbine feed ring 105 and the rear cover 106. An exhaust collection chamber 1031 is also provided by virtue of a recess which is machined into the main body portion 103 of the drive spindle 1. The extent of the exhaust collection chamber 1031 may be most clearly appreciated from FIG. 3B. Here it will be seen that an area covering nearly the whole of the available end surface of the main body portion 103 has been milled out to provide the chamber 1031. The only exception to this are a series of posts 1032 which project up from the base of the collection chamber and are for receiving fixings and a land 1033 which includes an air supply channel to the air bearing 103*a*.

The provision of the exhaust collection chamber 1031 allows air exhausting from the turbine to slow down before having to change direction to leave the drive spindle 1 via the rear cover 106. Moreover, this large chamber enables full use of the exhaust outlets provided. All of the exhaust air from the turbine (insofar as is practical) is directed to this exhaust collection chamber 1031 and moreover all of the exhaust outlet passages are connected to this common collection chamber 1031.

Returning now to FIG. 5 it can be noted that two of the apertures 1054 providing part of the respective exhaust outlet passages are provided radially inwardly of the gas supply chamber 1052. Their provision in this position helps to maximise the available exhaust paths out of the spindle but does give rise to a limitation of the space which the gas supply chamber 1052 may occupy. In order to counter this, in the present embodiment, the depth in the axial direction of the gas supply chamber 1052 is greater than the depth of the nozzles 1053 in the axial direction. This ensures that the gas supply chamber 1052 has the required volume for supplying gas to the turbine via the nozzles 1053. The exact volume of the gas supply chamber 1052 needed for different applications will vary based on a number of factors including the operating temperature and this fact may be taken into account by varying the depth of the gas supply chamber 1052 in the axial direction. This gives rise to a particularly efficient way for varying the configuration of the turbine feed ring 105.

It may be noted that a further gas supply nozzle 1055 is provided in the turbine feed ring 105. This supply nozzle 1055 supplies gas in the opposite circumferential direction to the two driving nozzles 1053 and is used for breaking, i.e. reducing the rotational speed of, the turbine and hence the shaft 102.

As mentioned above, the turbine 107 is directed so that the blades 1072 point away from the rear cover 106. This means that the rear of the turbine rotor body 1071 faces the rear cover 105 and this can be a useful surface for use in a speed pickup system. In particular, optical, magnetic or other indicators may be applied to the rear of the turbine rotor body 1071 such that these may be monitored by an appropriate sensor (not shown) to give a measure of rotational speed of the shaft. If such functionality is not required or is obtained in a different way it is possible to mount the turbine 107 the opposite way round, that is to say with the blades 1072 facing the rear cover 106. If this is done then the exhaust arrangements can be simplified.

In other alternatives more than one turbine 107 may be provided to drive the shaft 102. If more than one turbine 107 is provided these may be arranged back to back with the blades 1072 facing away from one another or front to back so that the blades 1072 of one turbine face the back of the other turbine.

More details of the geometry of the turbine 107 and turbine feed ring 105 will now be given with reference to FIGS. 8 to 10.

Figure 8:
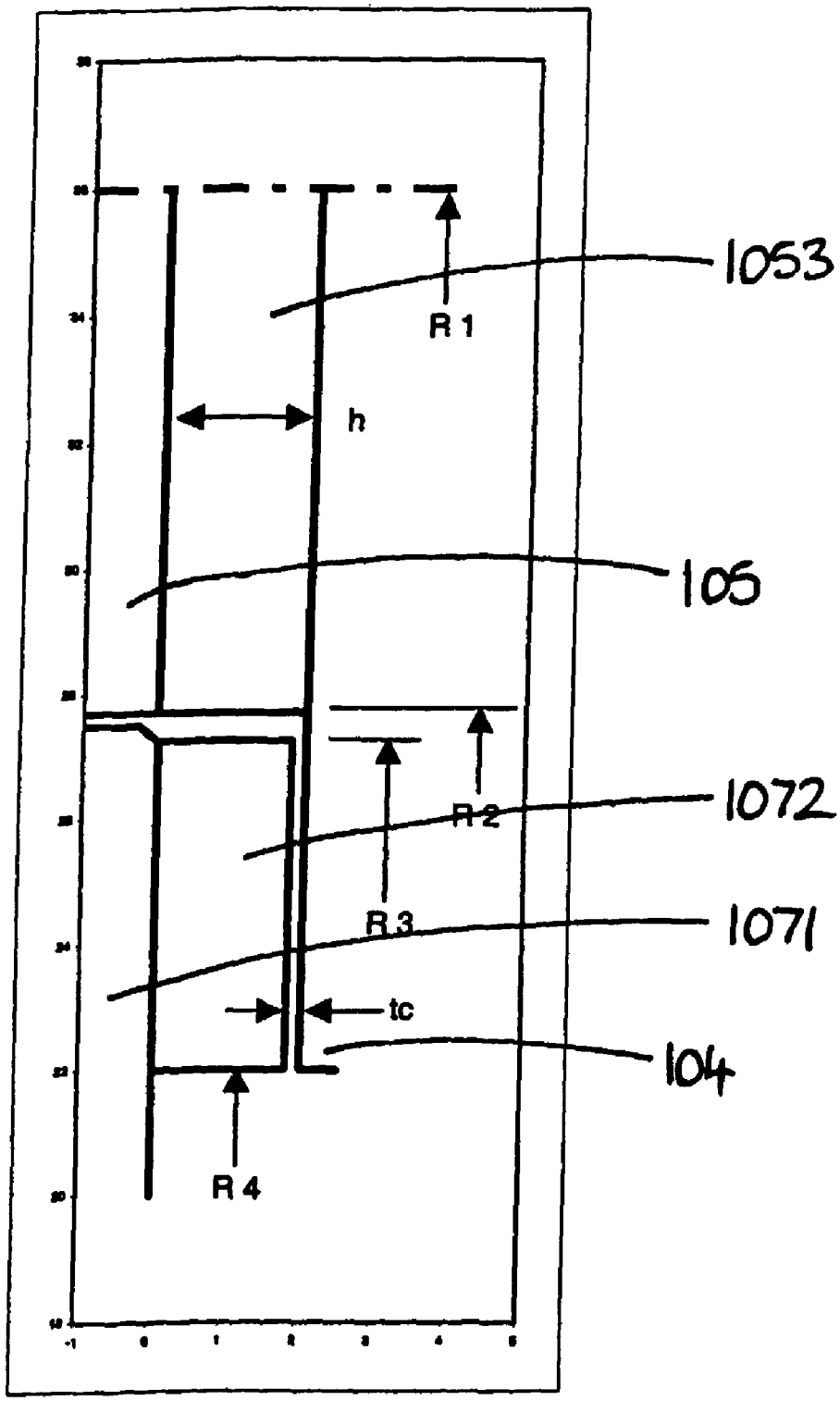
FIG. 8 is a schematic diagram helpful in defining various dimensional measurements of the turbine and turbine feed ring shown in FIG. 5.

FIG. 8 schematically shows one turbine blade 1072 of the turbine 107 and the surrounding structure of the turbine feed ring 105 as well as the spacer ring 104. Also shown on FIG. 8 are various parameters which are helpful in describing the setup of the turbine 107 in the spindle 1. R1 is the radius of the outermost point of the nozzle 1053 relative to the centre of rotation of the shaft 102. R2 is the inner radius of the nozzle 1053. R3 is the outer radius of the blade 1072. R4 is the inner radius of the blade 1072. In each case these radii are taken relative to the centre of rotation of the shaft 102. h is the nozzle height, i.e. the depth of the nozzle 1053 in the axial direction of the spindle 1 and tc is the tip clearance which is the spacing between the free flat surface of the blade 1072 and a facing surface of the spacer ring 104.

In an example spindle produced by the applicants R1=36 mm, R2=27.69 mm, R3=27.5 mm or slightly less than this, R4=22 mm, h=2 mm and tc=0.2 mm.

All of these dimensions can affect performance of the turbine and the tip clearance is particularly important if good efficiency is to be achieved as otherwise there will be a simple leakage path bypassing the blades.

Figure 9A:
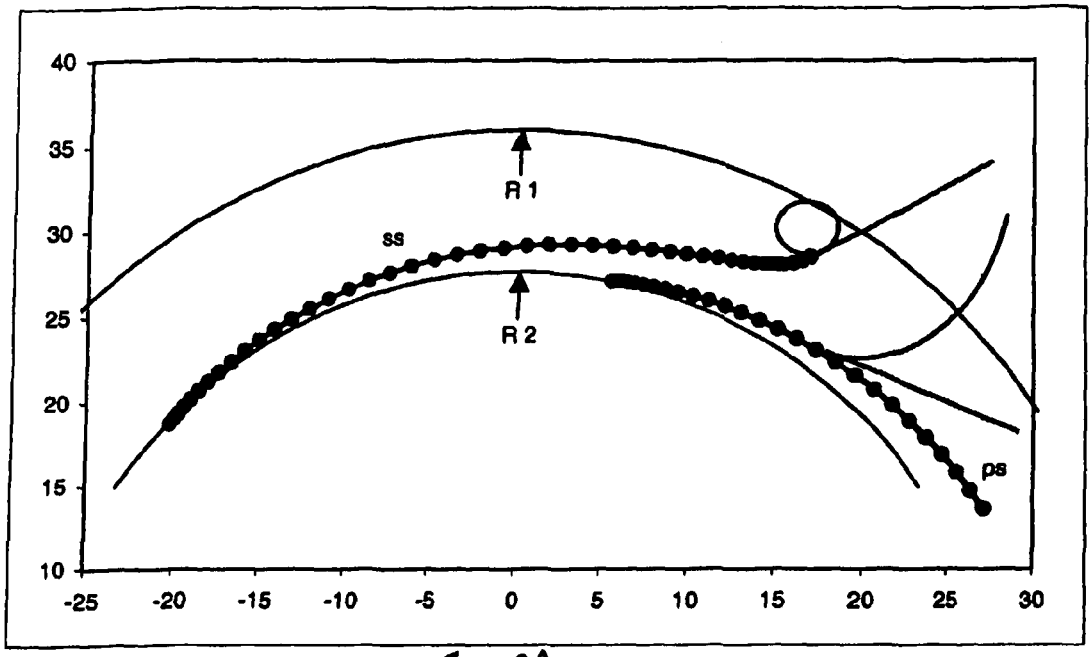
FIGS. 9A and 9B illustrate more accurately the shape of gas feed nozzles of the turbine feed ring shown in FIG. 5.

FIG. 9A shows co-ordinate points of the radially outer surface of the nozzle 1053 (i.e. the suction surface ss) and the radially inner surface of a nozzle 1053 (i.e. the pressure surface ps) in an example device produced by the applicants. Moreover table 1 below gives the values of the co-ordinate points for ps and ss as plotted on the plot shown in FIG. 9A. At all times the axis of rotation of the shaft 102 is the origin (0,0) of this co-ordinate system.

TABLE 1

| | x | y | | x | y |
|---|---|---|---|---|---|
| ps | 27.22375 | 13.60839 | ss | −20.2576 | 18.74997 |
| | 26.42584 | 14.70127 | | −20.0505 | 19.00559 |
| | 25.57688 | 15.78486 | | −19.7801 | 19.3296 |
| | 24.6783 | 16.84932 | | −19.4445 | 19.71741 |
| | 23.73284 | 17.88533 | | −19.0413 | 20.16345 |
| | 22.74454 | 18.88424 | | −18.5686 | 20.66131 |
| | 21.71865 | 19.83822 | | −18.0243 | 21.20375 |
| | 20.66156 | 20.74042 | | −17.4069 | 21.78285 |
| | 19.58067 | 21.58514 | | −16.7154 | 22.39013 |
| | 18.48418 | 22.36785 | | −15.9494 | 23.01661 |
| | 17.38094 | 23.08536 | | −15.1094 | 23.653 |
| | 16.28025 | 23.73574 | | −14.1968 | 24.28989 |
| | 15.19165 | 24.31842 | | −13.2139 | 24.91792 |
| | 14.12468 | 24.83403 | | −12.1642 | 25.528 |
| | 13.08877 | 25.28439 | | −11.0522 | 26.11151 |
| | 12.09302 | 25.67237 | | −9.8834 | 26.66046 |
| | 11.14606 | 26.00178 | | −8.66438 | 27.16776 |
| | 10.25593 | 26.2771 | | −7.40251 | 27.6273 |
| | 9.429989 | 26.50338 | | −6.10595 | 28.03418 |
| | 8.67485 | 26.68597 | | −4.78345 | 28.3848 |
| | 7.996364 | 26.83036 | | −3.44414 | 28.67694 |
| | 7.399601 | 26.94209 | | −2.0974 | 28.9098 |
| | 6.888841 | 27.02643 | | −0.7526 | 29.08405 |
| | 6.467605 | 27.08818 | | 0.581077 | 29.20175 |
| | 6.138686 | 27.13153 | | 1.894797 | 29.26627 |
| | 5.904184 | 27.15983 | | 3.180275 | 29.28222 |
| | 5.765511 | 27.17557 | | 4.429882 | 29.25523 |
| | 5.696249 | 27.17711 | | 5.636743 | 29.19178 |
| | 5.63442 | 27.16634 | | 6.794884 | 29.09905 |
| | 5.587222 | 27.1446 | | 7.899165 | 28.98469 |
| | 5.560075 | 27.11452 | | 8.945276 | 28.85656 |
| | Axis of rotation at 0, 0 | | | 9.929625 | 28.7225 |
| | | | | 10.84921 | 28.59003 |
| | | | | 11.70138 | 28.4661 |
| | | | | 12.48359 | 28.35674 |
| | | | | 13.19297 | 28.26668 |
| | | | | 13.82587 | 28.19893 |
| | | | | 14.37743 | 28.15418 |
| | | | | 14.84201 | 28.1305 |
| | | | | 15.2127 | 28.12331 |
| | | | | 15.4823 | 28.12596 |
| | | | | 16.06814 | 28.18252 |
| | | | | 16.60542 | 28.32625 |
| | | | | 17.06991 | 28.55258 |

Figure 9B:
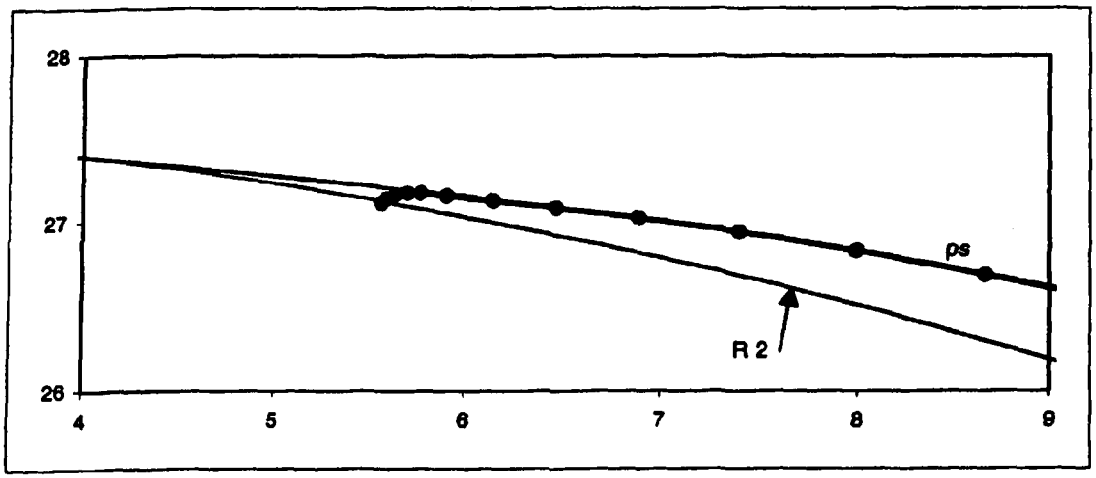

In the case of the example spindle produced by the applicants the size of the device was such that one co-ordinate point equalled one millimeter although of course the actual size of the device could be changed and the shape retained by scaling the co-ordinates up or down. FIG. 9B shows an alternative end to the pressure surface ps.

Figure 10:
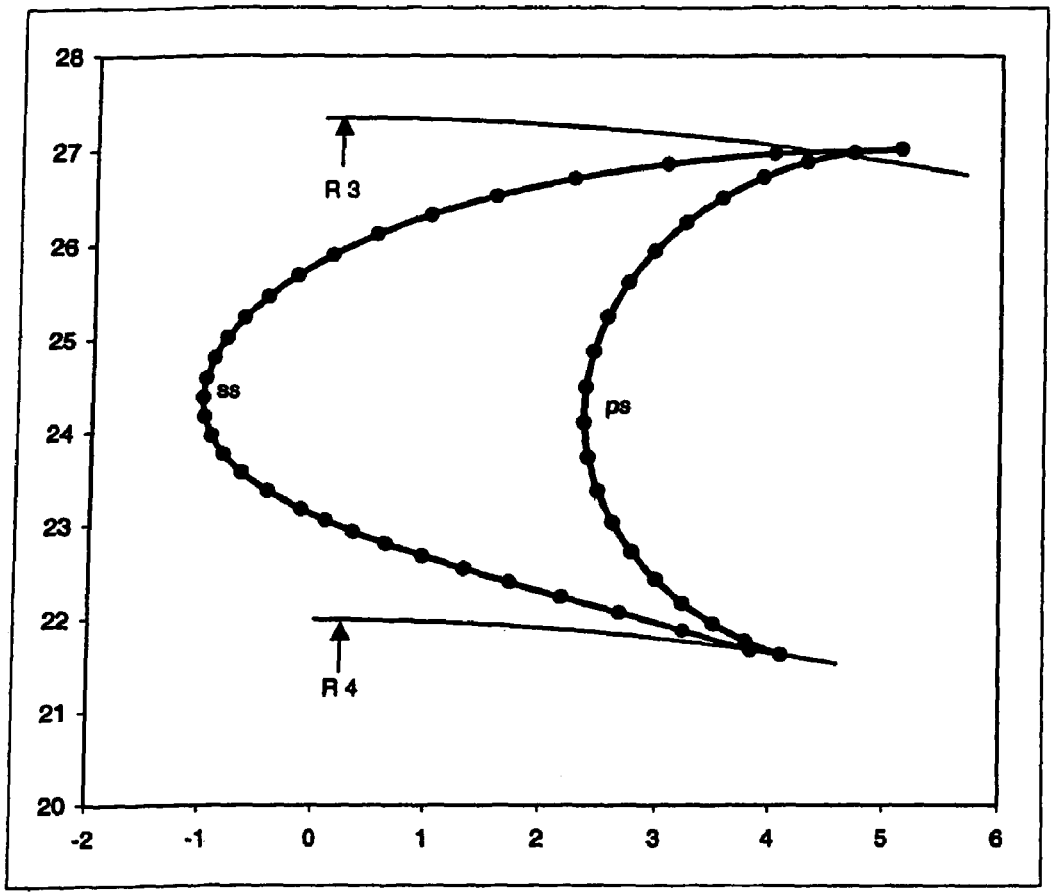
FIG. 10 more accurately shows the shape of blades of the turbine shown in FIG. 5.

FIG. 10 shows a plot of co-ordinates giving the shape of one of the blades 1072 of an example turbine produced by the applicants. Again the axis of rotation of the shaft 102 is at the origin (0,0). Furthermore, table 2 below shows the co-ordinate points for the pressure surface (ps) and suction surface (ss) of the blade as plotted in FIG. 10. Again, in the device produced by the applicants one co-ordinate point represents one millimeter but again this could be scaled up or down as desired.

TABLE 2

| | x | y | | x | y |
|---|---|---|---|---|---|
| ps | 5.127442 | 27.01776 | ss | 5.127442 | 27.01776 |
| | 4.699552 | 26.98234 | | 3.997104 | 26.97131 |
| | 4.28412 | 26.88286 | | 3.035171 | 26.86283 |
| | 3.891262 | 26.7229 | | 2.221799 | 26.71136 |
| | 3.530062 | 26.50776 | | 1.538156 | 26.53086 |
| | 3.208271 | 26.24412 | | 0.966921 | 26.33141 |
| | 2.932106 | 25.93971 | | 0.492568 | 26.12019 |
| | 2.706147 | 25.6029 | | 0.101503 | 25.90222 |

TABLE 2-continued

| x | y | x | y |
|---|---|---|---|
| 2.533338 | 25.24235 | −0.217884 | 25.68098 |
| 2.415067 | 24.86665 | −0.475218 | 25.45882 |
| 2.351315 | 24.4841 | −0.678182 | 25.23737 |
| 2.340845 | 24.10243 | −0.832568 | 25.01769 |
| 2.381423 | 23.72866 | −0.942341 | 24.80054 |
| 2.470036 | 23.36906 | −1.009709 | 24.58642 |
| 2.6031 | 23.02907 | −1.03519 | 24.37568 |
| 2.776643 | 22.71334 | −1.017682 | 24.16852 |
| 2.986464 | 22.4258 | −0.954527 | 23.965 |
| 3.228244 | 22.16968 | −0.841578 | 23.76492 |
| 3.497634 | 21.94766 | −0.673263 | 23.56775 |
| 3.790302 | 21.76191 | −0.442652 | 23.37245 |
| 4.101953 | 21.61421 | −0.141533 | 23.17719 |
| Axis of rotation at 0, 0 | | 0.080698 | 23.05693 |
| | | 0.334965 | 22.93471 |
| | | 0.623733 | 22.80934 |
| | | 0.949586 | 22.67932 |
| | | 1.3152 | 22.5428 |
| | | 1.723313 | 22.39749 |
| | | 2.176687 | 22.2406 |
| | | 2.678057 | 22.06874 |
| | | 3.230069 | 21.87786 |
| | | 3.835191 | 21.66313 |

Whilst nozzles 1053 and blades 1072 having the size and shape determined by the co-ordinates given in tables 1 and 2 have given particularly good results, it will of course be appreciated that devices having a similar effectiveness may be produced even if there are slight variations in some or all of these co-ordinates.

Figure 11B:
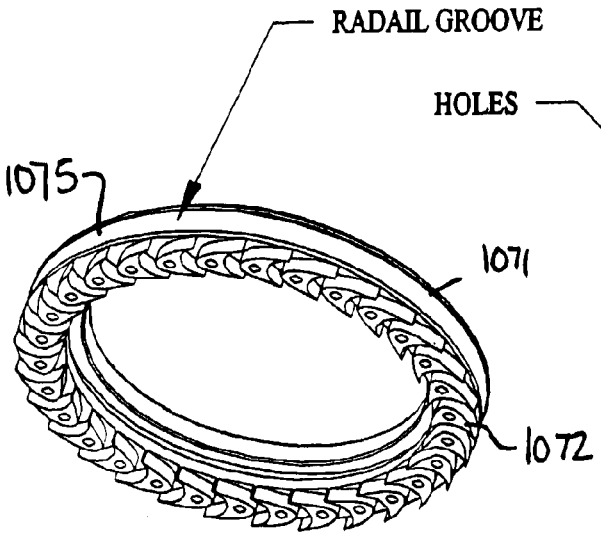
FIGS. 11A and 11B are respectively a plan and perspective view of an alternative turbine rotor.
Figure 11A:
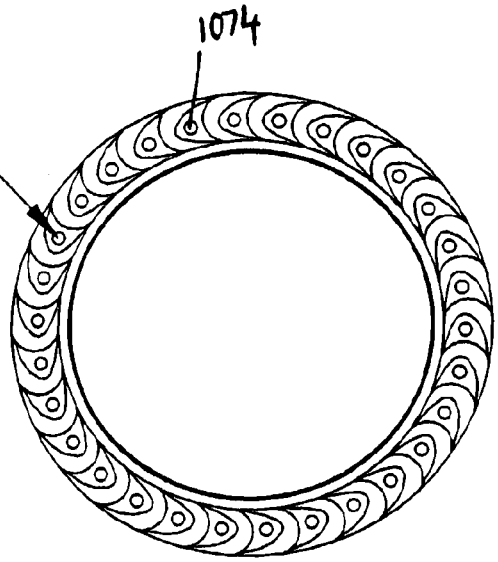
Figure 12:
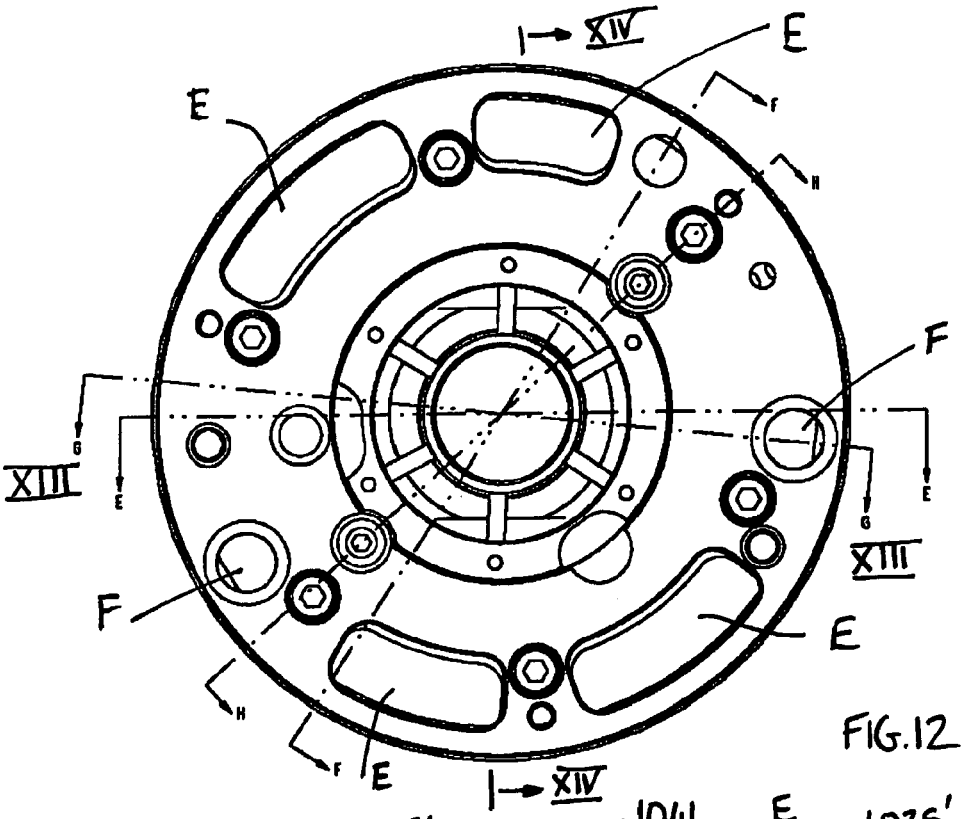
FIG. 12 shows an end view of an alternative rotary atomiser drive spindle which may be used in a rotary atomiser of the type shown in FIG. 1.

FIGS. 11A and 11B show an alternative form of turbine rotor. Again aerofoil like blades 1072 are provided on a ring shaped rotor body 1071. However, in this turbine 107, a hole 1074 is drilled in a generally axial direction through each of the blades 1072 and a wide groove 1075 is machined into the outer circumference surface of the rotor body 1071. In each case this is done to create further edges past which air must escape if it is to leak away from the desired path through the turbine. Thus if air is to leak over the free flat surface of the blade 1072 it must pass the edges of the respective hole 1074 and if air is to leak past the outer circumferential surface of the turbine without passing between the blades it must pass the groove 1075.

In general terms the provision of such surface features like these on the non-working surfaces of the turbine help to reduce losses as these features tend to interfere with the leakage of air because the introduction of edges or boundaries increases the resistance to airflow.

In the present alternative, these two measures also have the effect of reducing the weight of the turbine 107 as well as the polar moment of inertia of the turbine 107. These two factors can help reduce undesirable dynamic effects such as gyroscopic reactions and help to improve acceleration time when running the turbine 107 up to speed.

Other surface features may be added to similar effect. For example, rather than having axial holes drilled through the whole of the turbine 107 blind holes may be drilled into the flat free surfaces of the blades 1072.

Whilst in the present embodiment the drive spindle includes two drive nozzles, differing numbers of drive nozzles may be used to give desired power output or other characteristics. Furthermore, differing numbers of blades may be provided on the turbine and the height in the generally axial direction of the blades may be altered to give different powers. Moreover, the depth of the nozzles 1053 in the generally axial direction as well as their width may be varied to control power.

It has been found that a practical device made in accordance with the above specification has led to a 30% reduction in drive air flow and a similar reduction in air pressure needed to drive the turbine at the same speed as an alternative device which did not have the nozzle and turbine shapes and dimensions described above.

Described below with reference to FIGS. 12 to 18 is an alternative rotary atomiser driving spindle 1 which may be used in a rotary atomiser of the type shown in FIG. 1 in place of the drive spindle described above.

Many of the components in the alternative drive spindle shown in FIGS. 12 to 18 are the same or similar to those in the drive spindle described above. Therefore, for the sake of clarity the same reference numerals are used to denote the corresponding parts in the alternative drive spindle shown in FIGS. 12 to 18 and detailed description of some of the components of the drive spindle shown in FIGS. 12 to 18 is omitted for the sake of brevity.

Figure 15:
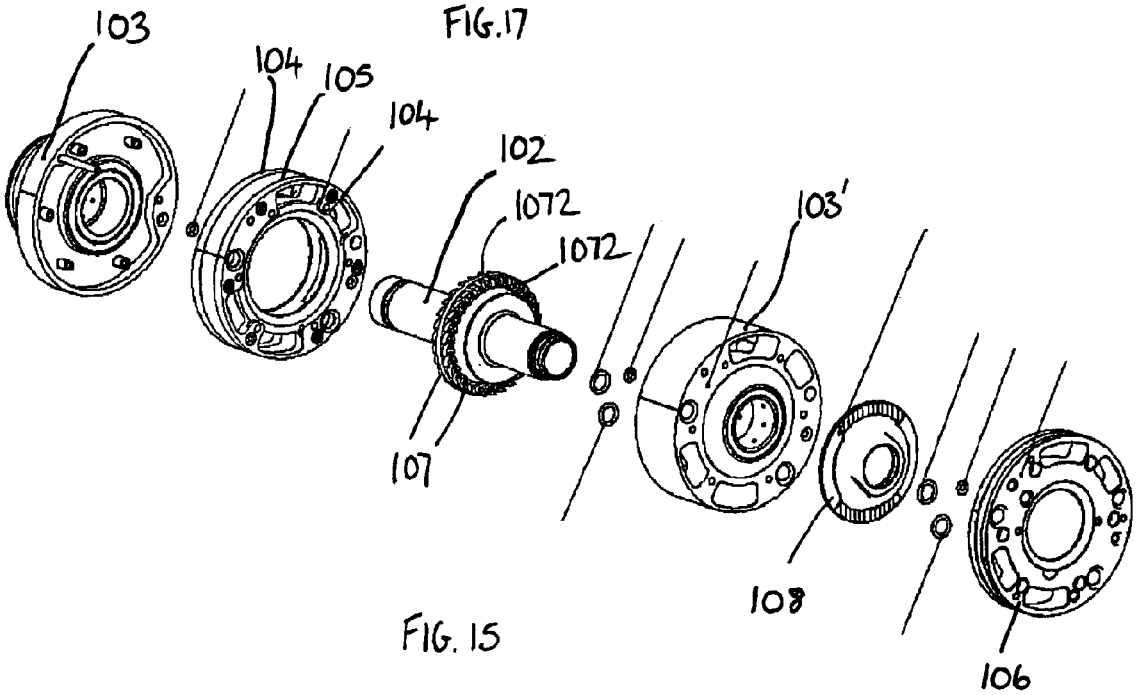
FIG. 15 shows an exploded view of the main components of the drive spindle shown in FIG. 12.

As is perhaps most easily seen in FIG. 15 the alternative driving spindle comprises a shaft 102 on which in this case, two turbines 107 are mounted. The turbines 107 are mounted in a back to back configuration so that the blades 1072 of one of the turbines face away from the blades 1072 of the other turbine.

Apart from the fact that there are two turbines 107 mounted back to back on the shaft 102, each turbine 107 is generally the same as the turbine 107 described above in relation to FIGS. 1 to 10 or alternatively, the variation shown in FIGS. 1A and 1B. Thus, detailed description of the construction, shape and dimensions of the turbines 107 in the present drive spindle is omitted.

The present drive spindle further comprises a front body portion 103 which corresponds fairly directly with the main body portion 103 of the driving spindle described above in relation to FIGS. 1 to 11B. However, the present drive spindle also comprises a rear body portion 103' which in at least some senses is similar to the front body portion 103.

The present driving spindle comprises a turbine feed ring 105 which is similar to that of the driving spindle described above in relation to FIGS. 1 to 11B. However, because there are two turbines 107 in the present driving spindle, the turbine feed ring 105 in the present drive spindle is arranged to feed air to both of the turbines 107. In the present drive spindle there are two spacer rings 104 which are situated on either side of the turbine feed ring 105. These two spacer rings 104 are similar to one another and similar to the spacer ring 104 in the drive spindle described above in relation to FIGS. 1 to 11B.

The present drive spindle also comprises a rear cover 106 which is similar to the rear cover of the drive spindle described above in relation to FIGS. 1 to 11B. In this particular embodiment a speed ring 108 for use in a shaft speed monitoring system is also provided in the spindle.

Figure 14:
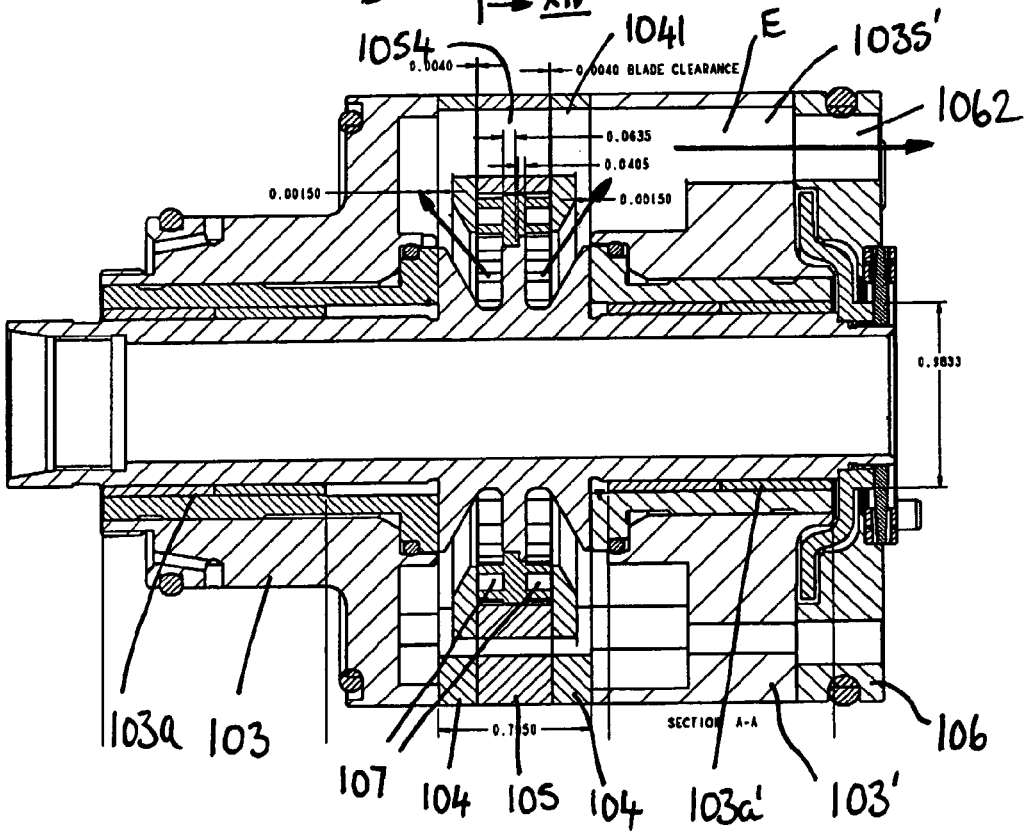
FIG. 14 shows a section on line XIV-XIV of the drive spindle shown in FIG. 12, which section shows part of the exhaust system of the drive spindle.
Figure 13:
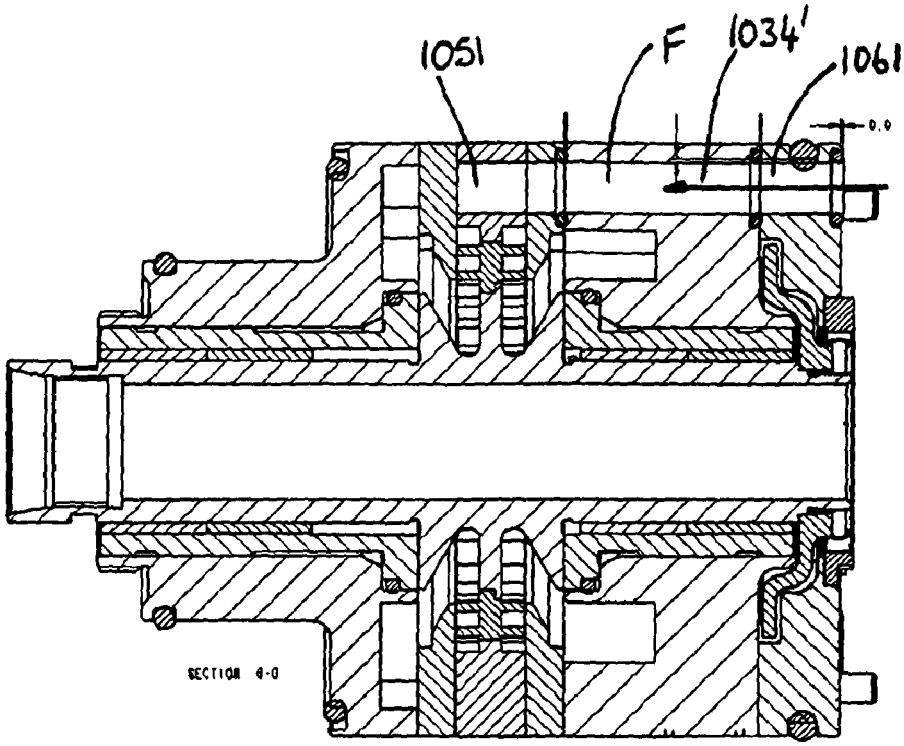
FIG. 13 shows a section on line XIII-XIII of the drive spindle shown in FIG. 12, which section shows a turbine drive air feed channel of the driving spindle.

With the spindle in its assembled state as shown in FIGS. 13 and 14, the shaft is journalled in two radial air bearings 103*a* (in the front body portion 103), 103'*a* (in the rear body portion 103'). These air bearings 103*a*, 103'*a* are spaced from one another. The twin turbines 107 are disposed in a position which is between the spaced air bearings 103*a*, 103'*a*. Moreover the spaced air bearings 103*a*, 103'*a* are spaced from one another as far as is practical within the overall dimension of the spindle. This helps to provide a "stiff" spindle where the shaft 102 is able to resist relatively high turning moments acting upon it.

In the assembled state, the twin turbines 107 are captured in position by the spacer rings 104 so as to be aligned with the turbine feed ring 105. To one side of one of the spacer rings 104 is the front body portion 103 and to the opposite side of the other spacer ring 104 is the rear body portion 103'. At the side of the rear body portion 103' that is opposite to that side which faces the respective spacer ring 104 is the rear cover portion 106.

In the present drive spindle, there are two turbine gas feed channels F provided in the body of the spindle 4 supplying gas to the turbines 107. One of these gas feed channels F can be seen in FIG. 13 and the entrance to both of these turbine gas feed channels F can be seen in FIG. 12. The feed channels F are defined by appropriate apertures 1061, 1034' and 1051 in the rear cover 106 rear body portion 103' and turbine feed ring 105 respectively.

Similarly a plurality, and in this case four, turbine gas exhaust channels E are provided in the body of the spindle. One of these exhaust channels E may be seen in FIG. 14 and the exits of the four channels E may be seen in FIG. 12.

Again, these exhaust channels E are defined by appropriate apertures 1062, 1035', 1041 and 1054 respectively in the rear cover 106, rear body portion 103', the spacer rings 104 and the turbine feed ring 105.

Figure 17:
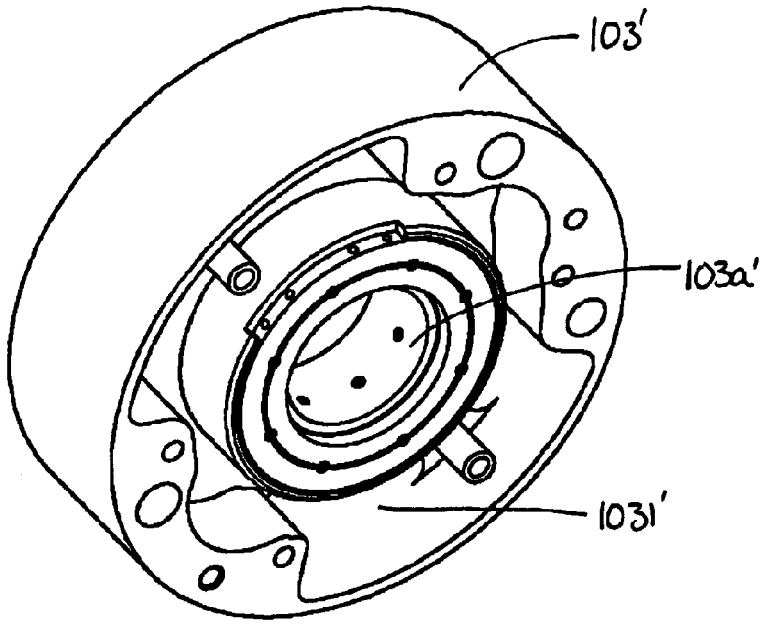
FIG. 17 is an underside view of a rear body portion of the drive spindle shown in FIG. 12.
Figure 16:
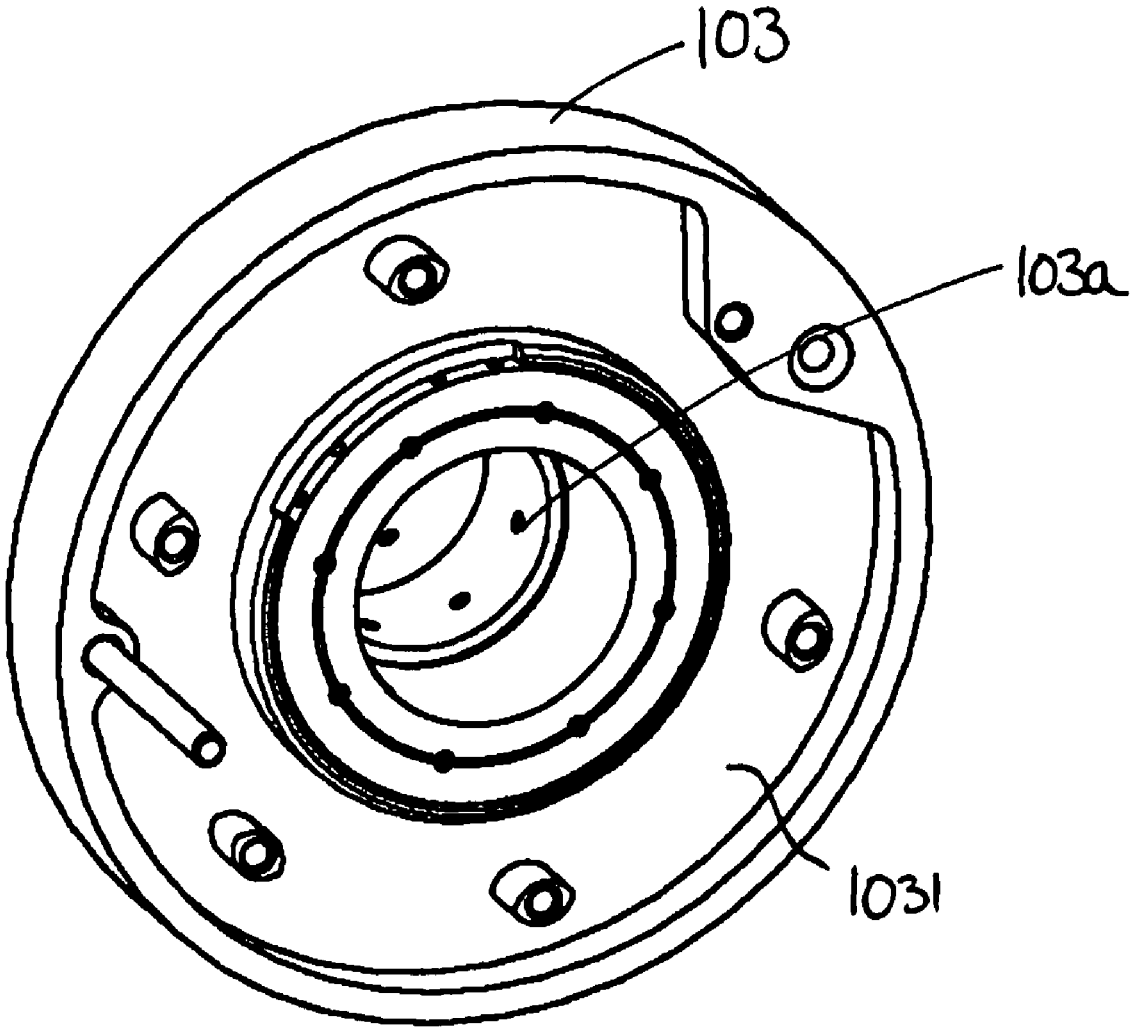
FIG. 16 is a three dimensional view of the underside of a front body portion of the drive spindle shown in FIG. 12.

As can be most clearly seen in FIG. 16, the front body portion 103 comprises an exhaust collection chamber 1031 which is similar to that of the main body portion 103 of the driving spindle described above in relation to FIGS. 1 to 11B. In the present driving spindle however, the rear body portion 103' also comprises an exhaust collection chamber 1031' as can be seen in FIG. 17. Similarly to the case with the exhaust collection chamber 1031 of the front body portion 103, the exhaust collection chamber 1031' of the rear body portion 103' is formed by milling out most of the material within the rear body portion 103'.

Both of these exhaust collection chambers 1031, 1031' perform a similar function in that they receive the exhaust gas (typically air) as it leaves the respective turbine 107. In effect the exhaust collection chamber 1031 in the front body portion 103 receives the exhaust air from the turbine 107 which is closest to the front body portion 103 and similarly the exhaust collection chamber 1031' in the rear body portion 103' receives the exhaust air from the turbine 107 which is closest to it. However, in the exhaust collection chamber 1031' of the rear body portion 103', the exhaust from both turbines 107 also can mix and intermingle before leaving via any one of the exhaust channels E.

The provision of these exhaust collecting chambers 1031, 1031' not only helps to improve the efficiency of the spindle overall (by minimising any throttling effect on the turbines 107), it also helps to provide a cooling effect to the material of the air bearings 103*a* and 103*a*'. As can be seen, for example in FIGS. 14, 16 and 17, the bearings 103*a*, 103*a*' are in the region of the respective exhaust collection chambers 1031, 1031'. The cooling function is particularly important in spindles which are arranged to operate with the shaft running at high rotational rates as this serves to heat the bearings. Furthermore, because of the high efficiency nature of the turbines used in the present driving spindle, the turbine drive gas undergoes significant expansion as it leaves the turbines 107 and thus cools dramatically. In some implementations, the gas can cool to close to zero degrees centigrade, where the turbine feed gas is delivered at room temperature. Thus, the circulation of this exhaust gas in the vicinity of the air bearings 103*a*, 103*a*' can have a significant cooling effect.

To enhance this cooling effect the spindle or at least those portions of it in the region of the exhaust collection chambers 1031 and 1031' can be made of aluminium and leaded gunmetal to ensure good thermal conduction from the bearing surface to the volume in the exhaust collection chambers 1031, 1031'.

It should be noted that the air bearings 103*a*, 103*a*' are rigidly mounted in the remainder of the spindle, i.e. in the front body portion 103 and rear body portion 103*a*'. This is to say, the set up is not one in which, say soft O rings, are provided within which the air bearings are mounted to provide an elastic mounting.

It will be noted that because of the orientation of the turbines 107 and the surrounding structure, the exhaust gas leaving one of the turbines 107 travels in a direction which is generally opposite to that in which exhaust gas leaves the other of the turbines 107. Thus, gas leaving the turbine 107 which is closest to the front body portion 103 must change direction in the region of the collecting chamber 1031 of the front body portion 103. On the other hand, gas leaving the turbine 107 closest to the rear body portion 103' can exit the spindle without making such a change in direction.

Figure 18:
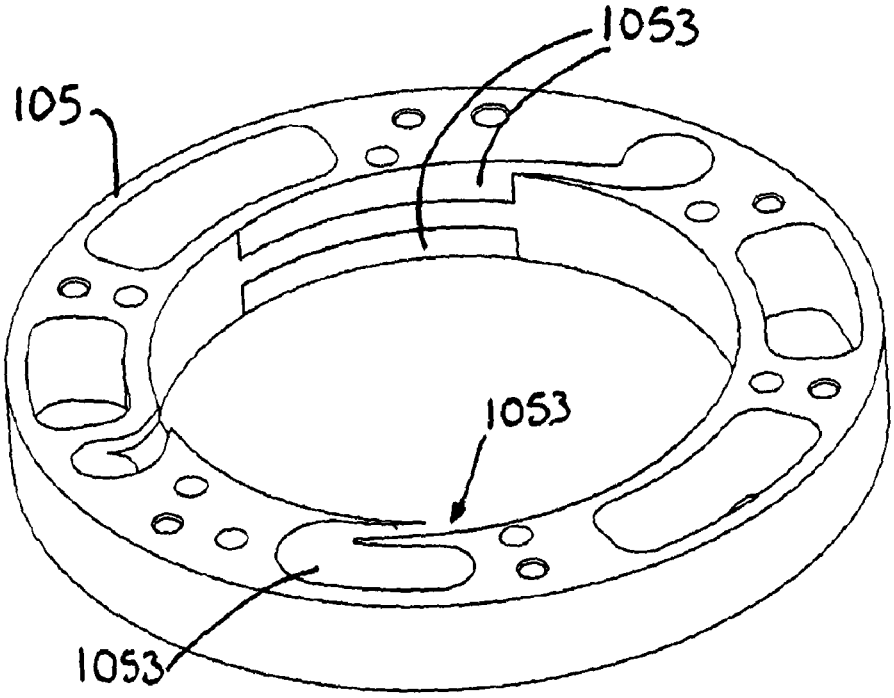
FIG. 18 shows a turbine feed ring of the driving spindle shown in FIG. 12.

FIG. 18 shows the turbine feed ring 105 of the present drive spindle in more detail. The feed ring 105 defines four drive nozzles 1053 each of which has a design similar to one or other of the drive nozzles 1053 in the feed ring 105 of the drive spindle described above in relation to FIGS. 1 to 11B. Two of the drive nozzles 1053 are arranged for supplying drive gas to one of the turbines 107 and the other two of the drive nozzles 1053 are arranged for supplying drive gas to the other of the turbines 107. Thus the drive nozzles 1053 can be considered to be arranged in pairs for supplying drive gas to diametrically opposed portions of a respective turbine. The nozzles for supplying gas to one of the turbines 107 are machined into one surface of the turbine feed ring 105 and the nozzles 1053 for supplying gas to the other turbine 107 are machined into the opposite surface of the turbine feed ring 105.

In the present embodiment, the turbine feed channels F are arranged to supply drive gas directly to the nozzles 1053 and thus in this drive spindle there is no gas supply chamber of the type provided in the spindle described above in relation to FIGS. 1 to 1B. It had been thought that the provision of such a gas supply chamber 1052 was important to provide smooth feeding of the turbine while allowing, for example, fluctuations in the pressure of the applied gas. However, it has been surprisingly found that such a gas supply chamber can be dispensed with whilst still achieving smooth drive. This is perhaps because there seems to be enough volume of gas in the turbine feed channels F themselves to provide the required dampening effect. The removal of the need for a gas supply chamber (in at least some embodiments) gives rise to an advantage in that there is then more room available in the spindle body for providing exhaust outlets. Hence, in the present drive spindle four exhaust outlets have been provided compared with the two which are provided in the spindle described above in relation to FIGS. 1 to 11B.

It should be noted that one of the turbine feed channels F provides drive gas to two of the circumferentially aligned nozzles 1053 whereas the other feed channel F provides gas to the other pair of circumferentially aligned nozzles 1053. Thus, each channel F provides gas to drive both of the turbines 107.

In setting up such a drive spindle for use in a rotary atomiser (particularly a paint sprayer) two separate supplies of air using flexible supply tubes will be connected to the inlets to the feed channels F.

As discussed above in the introduction to the specification, the provision of a spindle in which the shaft 102 is relatively stiffly mounted relative to the remainder of the spindle is advantageous where rapid movement of, for example, a spray head including the spindle can give rise to high gyroscopic forces which exert a significant turning moment on the shaft. Such forces can cause failure if the spindle, i.e. the bearing arrangement, is not sufficiently stiff to resist tilting of the shaft 102 relative to the bearings to such a degree that contact with the material of the bearings occurs.

The invention claimed is:

1. A rotary atomiser drive spindle for use as part of a rotary atomiser, the drive spindle comprising a shaft which carries a turbine and a body which comprises at least one supply channel for supplying gas to the turbine for rotatingly driving the shaft relative to the body, wherein the turbine comprises a rotor body portion, which is one of disc shaped and ring shaped, and a plurality of blades projecting from a generally flat surface of the rotor body portion with generally radial gas paths through the turbine being defined by adjacent pairs of blades and in which the at least one supply channel comprises a nozzle portion from which, in use, gas leaves the body of the spindle towards the turbine, the nozzle comprising an outlet and the cross sectional area of the gas passage through the nozzle portion decreasing monotonically from the inlet of the nozzle to the outlet, wherein the turbine comprises at least one surface feature to help reduce losses, wherein each blade is provided with one of a generally axial aperture and a blind recess which extends generally axially, and wherein the outlet of the nozzle is arranged to feed gas to a plurality of said generally radial gas paths through the turbine simultaneously.

2. A rotary drive spindle according to claim 1 in which the gas passage through the nozzle is partially defined by a suction surface and partially defined by a pressure surface, the suction surface having continuous curvature.

3. A rotary drive spindle according to claim 1 in which a reduction in nozzle cross section is achieved by a reduction in one dimension of the nozzle passage with the other dimension of the passage remaining substantially constant.

4. A rotary drive spindle according to claim 1 in which the nozzle follows an arcuate path in a plane which is perpendicular to a principle axis of the spindle.

5. A rotary drive spindle according to claim 1 in which the turbine is a reaction turbine.

6. A rotary drive spindle according to claim 1 in which the turbine is arranged so that at least one gas path has a first portion which decreases in cross sectional area from a first end to a second end, the first end being nearer to the inlet of the turbine than the second end.

7. A rotary drive spindle according to claim 6 in which the turbine is arranged so that said at least one gas path has a second portion which second portion increases in cross sectional area from a first end to a second end, the first end being nearer to the inlet of the turbine than the second end and the second portion is further from the inlet to the turbine than is the first portion.

8. A rotary drive spindle according to claim 1 in which the turbine is arranged so that said at least one gas path has a second portion which second portion increases in cross sectional area from a first end to a second end, the first end being nearer to the inlet of the turbine than the second end.

9. A rotary drive spindle according to claim 1 in which the blades project from a generally flat surface of a generally one of disc and ring shaped rotor body portion and each surface of each of the blades which faces a respective adjacent blade is curved in a generally radial direction and substantially flat in a generally axial direction.

10. A rotary drive spindle according to claim 1 in which the turbine blades have an aerofoil shape.

11. A rotary drive spindle according to claim 1 in which the turbine blades have an asymmetric shape.

12. A rotary drive spindle according to claim 1 in which the turbine blades are dimensioned and arranged to maintain laminar flow under a wide range of differing operating conditions.

13. A rotary drive spindle according to claim 1 in which the surface feature is provided on a non-working surface of the turbine.

14. A rotary drive spindle according to claim 1 in which a circumferential groove is provided in an outer curved surface of the turbine.

15. A rotary drive spindle according to claim 1 in which the spindle body comprises an exhaust system including at least one exhaust passage for carrying gas away from the outlet of the turbine.

16. A rotary drive spindle according to claim 15 in which the exhaust system comprises an exhaust collection chamber part way between the outlet of the turbine and an outlet of the exhaust system.

17. A rotary drive spindle according to according to claim 16 in which the exhaust system comprises at least one exhaust gathering passage for supplying exhaust from the outlet of the turbine to the exhaust collection chamber and a plurality of exhaust outlet passages for allowing exhaust gas to escape from the collection chamber to the exterior.

18. A rotary drive spindle according to claim 16 in which the exhaust collection chamber is provided at a location where the exhaust gas must change direction to escape.

19. A rotary drive spindle according to claim 15 in which the exhaust system is designed to one of inhibit and prevent at least one of turbulent flow and back pressure to maximise pressure drop across the turbine.

20. A rotary drive spindle according to claim 15 in which the exhaust system is arranged so that escaping exhaust gas cools the spindle.

21. A rotary drive spindle according to claim 20 in which the body of the spindle comprises two radial bearings which are spaced from one another and the exhaust system is arranged so that escaping exhaust gas cools both of the radial bearings.

22. A rotary drive spindle according to claim 21 in which at least one respective part of at least one exhaust passage passes close to each radial bearing.

23. A rotary drive spindle according to claim 21 in which the exhaust system comprises two exhaust collection chambers.

24. A rotary drive spindle according to claim 23 in which a first of the collection chambers is provided in the region of a first of the radial bearings and a second of the collection chambers is provided in the region of a second of the radial bearings.

25. A rotary drive spindle according to claim 23 in which there are two turbines and the exhaust system comprises a first exhaust gathering passage for supplying exhaust from the outlet of a first of the turbines to a first of the collection chambers and a second exhaust gathering passage for supplying exhaust from the outlet of a second of the turbines to a second of the collection chambers.

26. A rotary drive spindle according to claim 1 in which the body of the spindle comprises two radial bearings which are spaced from one another.

27. A rotary drive spindle according to claim 26 in which the turbine is disposed between the spaced radial bearings.

28. A rotary drive spindle according to claim 27 in which the shaft carries two turbines which are disposed between the spaced radial bearings.

29. A rotary drive spindle according to claim 26 in which the bearings are rigidly mounted in the remainder of the body of the spindle.

30. A rotary drive spindle according to claim 1 in which the shaft carries two turbines.

31. A rotary drive spindle according to claim 1 in which the shape of the or each nozzle is substantially that defined by the co-ordinates given in table 1.

32. A rotary drive spindle according to claim 1 in which the shape of the or each nozzle is that defined by the co-ordinates given in table 1 to within 0.01 of each co-ordinate value.

33. A rotary drive spindle according to claim 1 in which the shape of the or each blade is substantially that defined by the co-ordinates given in table 2.

34. A rotary drive according to claim 1 in which the shape of the or each blade is that defined by the co-ordinates given in table 2 to within 0.01 of each co-ordinate value.

35. A rotary atomiser which comprises a drive spindle according to claim 1, a bell-shaped member which is rotatable about a principle axis and is arranged to project a conical curtain of small particles flowing generally towards a target and a supply arrangement for supplying material, from which the small particles can be generated, from a reservoir source to the bell-shaped member.

36. A rotary atomiser drive spindle for use as part of a rotary atomiser, the drive spindle comprising a shaft which carries a turbine and a body which comprises at least one supply channel for supplying gas to the turbine for rotatingly driving the shaft relative to the body, wherein the turbine comprises a rotor body portion, which is one of disc shaped and ring shaped, and a plurality of blades projecting from a generally flat surface of the rotor body portion with generally radial gas paths through the turbine being defined by adjacent pairs of blades and in which the at least one supply channel comprises a nozzle portion from which, in use, gas leaves the body of the spindle towards the turbine, the nozzle comprising an outlet and the cross sectional area of the gas passage through the nozzle portion decreasing monotonically from the inlet of the nozzle to the outlet, wherein the turbine comprises at least one surface feature to help reduce losses, wherein a circumferential groove is provided in an outer curved surface of the turbine, and wherein the outlet of the nozzle is arranged to feed gas to a plurality of said generally radial gas paths through the turbine simultaneously.

37. A rotary atomiser drive spindle for use as part of a rotary atomiser, the drive spindle comprising a shaft which carries a turbine and a body which comprises at least one supply channel for supplying gas to the turbine for rotatingly driving the shaft relative to the body, wherein the turbine comprises a rotor body portion, which is one of disc shaped and ring shaped, and a plurality of blades projecting from a generally flat surface of the rotor body portion with generally radial gas paths through the turbine being defined by adjacent pairs of blades and in which the at least one supply channel comprises a nozzle portion from which, in use, gas leaves the body of the spindle towards the turbine, the nozzle comprising an outlet and the cross sectional area of the gas passage through the nozzle portion decreasing monotonically from the inlet of the nozzle to the outlet, wherein the shape of the or each nozzle is substantially that defined by the co-ordinates given in table 1, and wherein the outlet of the nozzle is arranged to feed gas to a plurality of said generally radial gas paths through the turbine simultaneously.

38. A rotary atomiser drive spindle for use as part of a rotary atomiser, the drive spindle comprising a shaft which carries a turbine and a body which comprises at least one supply channel for supplying gas to the turbine for rotatingly driving the shaft relative to the body, wherein the turbine comprises a rotor body portion, which is one of disc shaped and ring shaped, and a plurality of blades projecting from a generally flat surface of the rotor body portion with generally radial gas paths through the turbine being defined by adjacent pairs of blades and in which the at least one supply channel comprises a nozzle portion from which, in use, gas leaves the body of the spindle towards the turbine, the nozzle comprising an outlet and the cross sectional area of the gas passage through the nozzle portion decreasing monotonically from the inlet of the nozzle to the outlet, wherein the shape of the or each nozzle is that defined by the co-ordinates given in table 1 to within 0.01 of each co-ordinate value, and wherein the outlet of the nozzle is arranged to feed gas to a plurality of said generally radial gas paths through the turbine simultaneously.

39. A rotary atomiser drive spindle for use as part of a rotary atomiser, the drive spindle comprising a shaft which carries a turbine and a body which comprises at least one supply channel for supplying gas to the turbine for rotatingly driving the shaft relative to the body, wherein the turbine comprises a rotor body portion, which is one of disc shaped and ring shaped, and a plurality of blades projecting from a generally flat surface of the rotor body portion with generally radial gas paths through the turbine being defined by adjacent pairs of blades and in which the at least one supply channel comprises a nozzle portion from which, in use, gas leaves the body of the spindle towards the turbine, the nozzle comprising an outlet and the cross sectional area of the gas passage through the nozzle portion decreasing monotonically from the inlet of the nozzle to the outlet, wherein the shape of the or each nozzle is that defined by the co-ordinates given in table 2, and wherein the outlet of the nozzle is arranged to feed gas to a plurality of said generally radial gas paths through the turbine simultaneously.

40. A rotary atomiser drive spindle for use as part of a rotary atomiser, the drive spindle comprising a shaft which carries a turbine and a body which comprises at least one supply channel for supplying gas to the turbine for rotatingly driving the shaft relative to the body, wherein the turbine comprises a rotor body portion, which is one of disc shaped and ring shaped, and a plurality of blades projecting from a generally flat surface of the rotor body portion with generally radial gas paths through the turbine being defined by adjacent pairs of blades and in which the at least one supply channel comprises a nozzle portion from which, in use, gas leaves the body of the spindle towards the turbine, the nozzle comprising an outlet and the cross sectional area of the gas passage through the nozzle portion decreasing monotonically from the inlet of the nozzle to the outlet, wherein the shape of the or each nozzle is that defined by the co-ordinates given in table 2 to within 0.01 of each co-ordinate value, and wherein the outlet of the nozzle is arranged to feed gas to a plurality of said generally radial gas paths through the turbine simultaneously.

* * * * *